US009150046B2

(12) United States Patent
Fijnvandraat et al.

(10) Patent No.: US 9,150,046 B2
(45) Date of Patent: Oct. 6, 2015

(54) ENVELOPE INSERTING APPARATUS

(75) Inventors: Hendrik Cornelis Fijnvandraat, Enschede (NL); Christiaan Antoon Munneke, Drachten (NL)

(73) Assignee: NEOPOST TECHNOLOGIES, Bagneux (FR)

( * ) Notice: Subject to any disclaimer, the term of this patent is extended or adjusted under 35 U.S.C. 154(b) by 895 days.

(21) Appl. No.: 12/915,839

(22) Filed: Oct. 29, 2010

(65) Prior Publication Data

US 2011/0099946 A1 May 5, 2011

(30) Foreign Application Priority Data

Oct. 29, 2009 (EP) ..... 09174521

(51) Int. Cl.
*B43M 3/04* (2006.01)

(52) U.S. Cl.
CPC ..... *B43M 3/045* (2013.01)

(58) Field of Classification Search
CPC ..... B43M 3/045; B43M 5/042; B43M 3/04
USPC ..... 53/468, 469, 569, 381.3, 381.5, 381.7; 270/58.06
See application file for complete search history.

(56) References Cited

U.S. PATENT DOCUMENTS

| | | | | | |
|---|---|---|---|---|---|
| 4,712,359 | A | * | 12/1987 | DePasquale et al. | 53/460 |
| 4,817,368 | A | * | 4/1989 | DePasquale et al. | 53/460 |
| 5,154,404 | A | * | 10/1992 | Lee et al. | 270/58.06 |
| 5,168,689 | A | | 12/1992 | Macelis | |
| 5,211,384 | A | | 5/1993 | Orsinger et al. | |
| 5,247,780 | A | * | 9/1993 | Kulpa et al. | 53/381.5 |
| 5,517,797 | A | | 5/1996 | Ballard et al. | |
| 5,630,312 | A | | 5/1997 | Ballard et al. | |
| 5,675,959 | A | * | 10/1997 | Hamma et al. | 53/381.1 |
| 5,715,648 | A | * | 2/1998 | Yates | 53/381.5 |
| 5,729,954 | A | * | 3/1998 | Lines et al. | 53/381.7 |
| 6,425,223 | B1 | * | 7/2002 | Miller et al. | 53/381.6 |
| 7,155,878 | B2 | * | 1/2007 | Stemmle et al. | 53/381.5 |
| 7,320,204 | B2 | * | 1/2008 | Alzner et al. | 53/459 |
| 7,398,635 | B2 | * | 7/2008 | Fairweather et al. | 53/569 |
| 7,401,448 | B2 | * | 7/2008 | Sytema et al. | 53/381.7 |

(Continued)

FOREIGN PATENT DOCUMENTS

| | | |
|---|---|---|
| EP | 1 088 682 A1 | 4/2001 |
| WO | 98/14371 A2 | 4/1998 |

*Primary Examiner* — Stephen F Gerrity
*Assistant Examiner* — Eyamindae Jallow
(74) *Attorney, Agent, or Firm* — Seed IP Law Group PLLC

(57) ABSTRACT

An inserting apparatus, for inserting documents into envelopes, comprising:

Figure 1:
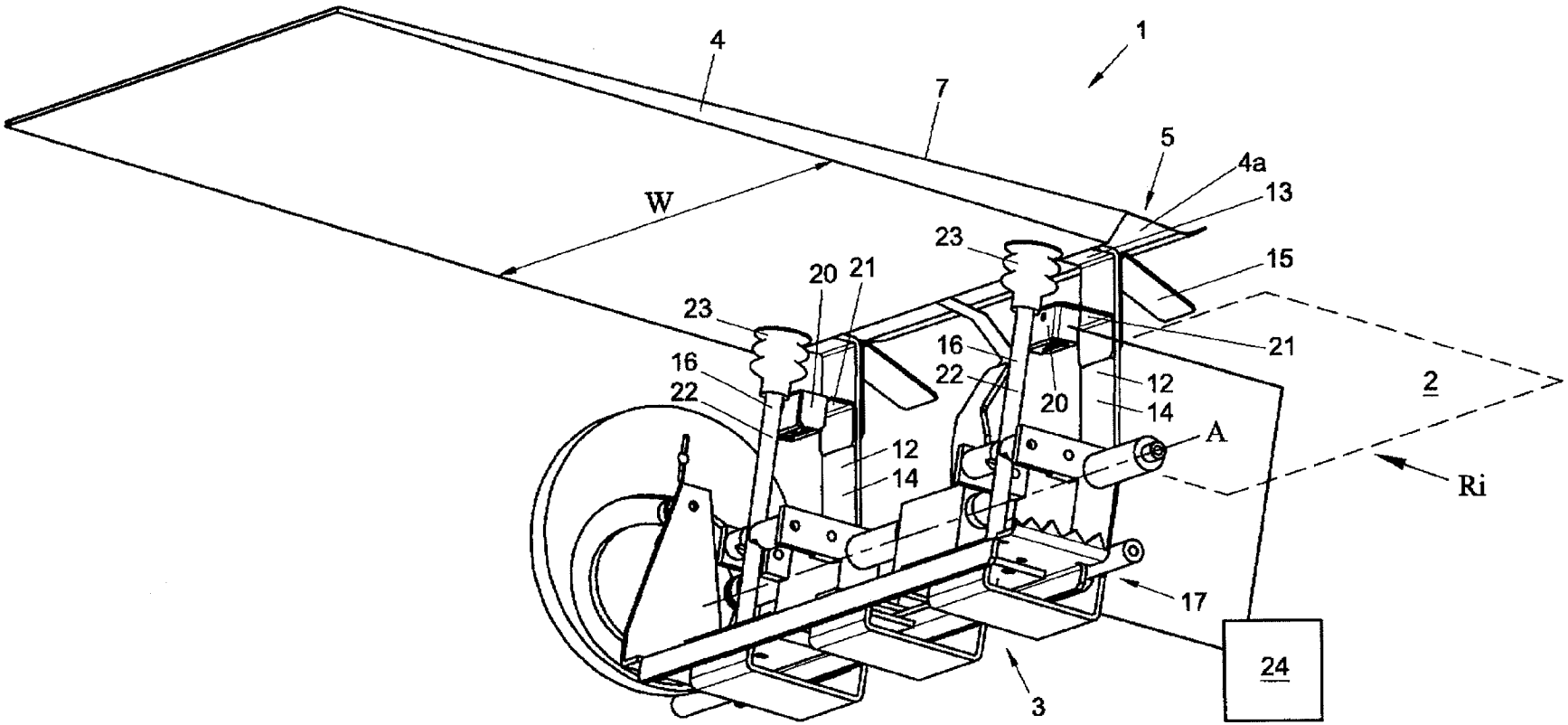

an envelope holder for holding an envelope at least in a document inserting position, a document inserting path arranged upstream of the envelope holder for feeding a document to the envelope, an envelope opening device comprising an opening element adapted to be inserted in the envelope to move an envelope throat and an envelope body away from each other, the opening element comprising an opening element inserting finger arranged to be inserted in an inner space of the envelope, a sensor device with a primary sensor part mounted to the inserting finger and a secondary sensor part mounted to a base part or to the inserting finger of the opening element, wherein the sensor device is adapted to detect if the inserting finger is positioned in between the throat and the body.

28 Claims, 11 Drawing Sheets

(56) References Cited

U.S. PATENT DOCUMENTS

| | | | | |
|---|---|---|---|---|
| 7,424,798 | B2 * | 9/2008 | Sytema | 53/564 |
| 7,437,862 | B2 * | 10/2008 | van der Werff | 53/569 |
| 7,556,250 | B2 * | 7/2009 | Beck | 270/58.06 |
| 7,581,723 | B2 * | 9/2009 | Hascup | 270/1.03 |
| 7,788,880 | B2 * | 9/2010 | Kern | 53/381.7 |
| 7,950,646 | B2 * | 5/2011 | Scheltes et al. | 270/58.06 |
| 8,234,845 | B2 * | 8/2012 | Fairweather et al. | 53/460 |
| 8,312,698 | B2 * | 11/2012 | Munneke | 53/493 |
| 8,453,417 | B2 * | 6/2013 | Oshio et al. | 53/53 |
| 8,453,418 | B2 * | 6/2013 | Smith et al. | 53/381.7 |
| 8,468,779 | B2 * | 6/2013 | Kannankeril et al. | 53/403 |
| 2002/0124536 | A1 * | 9/2002 | Sting et al. | 53/569 |
| 2003/0041571 | A1 * | 3/2003 | Haller et al. | 53/569 |
| 2004/0211158 | A1 * | 10/2004 | Miller et al. | 53/468 |
| 2004/0250517 | A1 * | 12/2004 | Hsieh | 53/569 |
| 2004/0255561 | A1 * | 12/2004 | Heilman | 53/569 |
| 2005/0072127 | A1 * | 4/2005 | Botschek et al. | 53/569 |
| 2005/0160703 | A1 * | 7/2005 | van der Werff | 53/460 |
| 2008/0179223 | A1 * | 7/2008 | Van Netten et al. | 209/509 |
| 2010/0059918 | A1 * | 3/2010 | Kern et al. | 270/58.06 |
| 2010/0127451 | A1 * | 5/2010 | Rozenfeld et al. | 271/256 |

* cited by examiner

ENVELOPE INSERTING APPARATUS

FIELD AND BACKGROUND OF THE INVENTION

The invention relates to an inserting apparatus for inserting documents into envelopes, the apparatus comprising an envelope holder for holding an envelope at least in a document inserting position being an open position of a first upstream end of the envelope for receiving a document, a document inserting path arranged upstream of the envelope holder for feeding at least one document to the envelope in a document inserting direction, an envelope opening device comprising at least one opening element adapted to be inserted in the envelope to move an envelope throat and an envelope body away from each other to bring the envelope in the open position, the opening element comprising an opening element inserting finger arranged to be inserted in an inner space of the envelope.

Such an inserting apparatus is known from practice and may further comprise a document displacement arrangement for displacement of the document at least along the document inserting path into the envelope. Such a displacement arrangement comprises at least one displacement element that is adapted to push the document into the envelope. A drawback of such an inserting apparatus is that in operation it is not certain if the at least one opening element is actually brought into the inner space of the envelope. Consequently, it is not certain if the envelope throat and the envelope body are moved away from each other such that a document to be inserted can be easily inserted in the envelope. The opening element may for instance be moved towards the envelope but due to several reasons is not able to reach into the envelope. The envelope will not be brought in the open position, which can result in a document jam in the inserting apparatus, wherein the document to be inserted may be damaged. Such a jam can be removed by the operator of the inserting apparatus, which is a time costly and thus expensive operation. Furthermore, in case the document is damaged too badly, a replacement document has to be provided. This is especially not desired in case of addressed documents. It is further known from practice to provide the inserting apparatus with a sensor to detect if the opening element did open the envelope throat. However, a drawback of the availability of such a sensor is that in case the envelope width has to be changed, the settings of the apparatus have to be adapted to that new envelope width to be used in the apparatus. Consequently, the sensor settings have to be adapted such that the transmitted signal receives the receiver of the sensor. Adjustment of the settings takes time and can result in mistakes and thus in paper jams. Consequently, a risk of disturbance of the inserting process still exists.

SUMMARY OF THE INVENTION

It is an object of the present invention to provide an envelope inserting apparatus for inserting documents into envelopes, wherein jamming of the document due to non-opening of the envelope is minimized. More in particular, it is an object of the present invention to provide an envelope inserting apparatus that is adapted to monitor proper opening of the envelope before insertion of the document, wherein at the same time the apparatus is adapted to process envelopes of different dimensions.

In order to achieve the above mentioned object, an inserting apparatus for inserting documents into envelopes according to claim 1 is provided. The inserting apparatus for inserting documents into envelopes, according to the preamble is characterized in that it further comprises:

a sensor device with a primary sensor part and a secondary sensor part, wherein the sensor device is adapted to detect if the opening element inserting finger is positioned in between the envelope throat and the envelope body, wherein the primary sensor part of the sensor device is mounted to the opening element inserting finger and the secondary sensor part is mounted to the opening element, preferably to a base part of the opening element.

Due to such a sensor device, adjustment of the settings of the opening element with respect to an envelope does not influence the sensor settings. Thus, in case the operator changes the kind of envelopes to be used in the inserting apparatus, the location of the at least one opening element may be adapted as well without the need to adapt the sensor settings. In fact, upon movement of the opening element, both sensor parts that are necessary to determine if the opening element enters the inner space of the envelope, move along with the opening element. Therefore, the cooperation between the sensor parts is not interrupted. Consequently, upon change of the type of envelope, only the position of the at least one opening element has to be changed accordingly. The document inserting process only has to be interrupted for the shortest possible period and the risk of occurrence of mistakes is decreased. Both sensor parts can be mounted to the opening element during manufacture of the apparatus. Calibration of the sensor device thus takes place before the inserting apparatus is in operation. Only when a part of the sensor device has to be replaced, adjustment of the settings of the sensor device may be necessary.

It is noted that the term 'document' throughout this application should be interpreted in a broad way. The term document refers to at least one or more sheets, magazines, books and other suitable inserts such as a CD, DVD or the like and any combination thereof.

The sensor device of the inserting apparatus according to the invention can have different configurations. It is for instance possible, according to a further elaboration of the invention, that one of the primary sensor part and the secondary sensor part may be an optical receiver and/or the other one of the primary sensor part and the secondary sensor part may be an optical transmitter. In case the opening element is inserted in the inner space of the envelope, the emitted optical signal by the primary sensor part is interrupted by the envelope throat that is positioned in between the primary and secondary sensor parts. Consequently, the receiver will not receive the emitted signal such that it is certain that the opening element is provided between the envelope throat and the envelope body. It is advantageous if the primary sensor part that is provided on the opening element inserting finger has limited dimensions such that the presence of the primary sensor part does not influence the inserting process. Therefore for instance, one of the sensor parts may be a light emitting diode (LED) and the other one of the sensor parts may be a light receiving sensor. In another embodiment of the sensor device of the optical nature, one of the sensor parts may be a refractor or a mirror and the other one of the sensor parts may then comprise a LED and a light receiving sensor. A LED, a refractor or a mirror may be located on the opening element inserting element due to the limited height of such a primary sensor part.

In a further embodiment of the optical sensor device, one of the sensor parts may comprise a glass fibre conductor, wherein a first end of the glass fibre conductor is adapted to transmit a signal, wherein a second end of the glass fibre conductor is connected to a light emitting device and wherein the other one of the sensor parts may be a light receiving sensor. In this case, the light emitting device can be positioned adjacent the opening element, but does not have to be attached to the opening element inserting finger since the glass fibre conductor is provided on said inserting finger. The glass fibre conductor provided on the opening element inserting finger transmits the optical signal that is emitted by the light emitting device to the light receiving sensor. When displacing the opening element due to a change in envelope width, the glass fibre conductor as well as the light receiving sensor is displaced as well. The light emitting device can stay in place.

In an alternative embodiment of the sensor device according to the invention, the primary sensor part and the secondary sensor part of the sensor device may be of a mechanical nature. The sensor device may for instance comprise a contact sensor. Sensing the presence of the envelope throat in between both sensor parts may be obtained by interrupting the contact between both sensor parts or by establishing contact between both sensor parts, dependent on the kind of sensor device used.

In order to enable positioning of the envelope throat between the primary and the secondary sensor parts, the secondary sensor part may be connected to the opening element at a distance from the primary sensor part. Preferably, the distance is such that the envelope part in between both sensor parts will not collide with either part upon insertion of the opening element inserting finger in the inner space of the envelope.

In an alternative embodiment of the invention, both the primary sensor part and the secondary sensor part may be provided on the opening element inserting finger, at least on a part of the finger that is configured to be brought into the inner space of the envelope, wherein both sensor parts cooperate to detect opening of the envelope by means of reflection and/or scattering by the envelope, more in particular by the envelope wall opposite the sensor parts. With such an embodiment, different kinds of emitters and sensors, for instance an optical receiver and an optical transmitter, a light emitter and a light receiving sensor as above described, or the like elements may be used. Such sensor parts may be adapted to detect a change in reflection and/or scattering of the light by the material of the envelope in case the opening element inserting finger is inserted between the envelope throat and the envelope body. When the finger is not inserted correctly, no change in reflection and/or scattering may be detected or a change deviating from the expected predetermined change in case of correct insertion may be detected. Thus, by detecting no change at all or an unexpected change in reflection and/or scattering, incorrect inserting of the inserting finger may be determined. Depending on the kind of material of the envelope a predetermined change can be set such that during insertion, the actual change can be compared to the predetermined change. In case of a deviation between the actual change and the predetermined change for a certain kind of envelope, improper insertion may be detected easily.

With such an embodiment of the invention, adjustment of the settings of the opening element with respect to an envelope may be arranged in a simple manner without needing to modify the sensor settings. Furthermore, upon substantial change of envelope width (i.e. the size along the side of the flap) only the opening element position has to be changed. The sensor parts automatically move along with the opening element. This enables use of relatively little and simple elements to detect correct insertion of the inserting finger into the envelope body and besides that, only little light intensity is needed during detection, thereby preventing disturbing other sensors provided in the apparatus and at the same time minimizing energy use during operation. The lateral position of the respective inserting fingers may be known by the control unit of the inserting apparatus, since the inserting fingers may for instance be mounted on a rotating spindle that is configured to move the inserting fingers in lateral direction for adjustment to the width of the envelope, in such way that the lateral movement of the fingers can be derived from determination of the rotation of the spindle. The lateral position may also be determined by any kind of suitable sensor.

In further elaboration of the invention, the inserting finger may be provided with an array of multiple sensor devices, wherein the respective primary sensor parts and the respective secondary sensor parts of each sensor device are mounted in pairs, wherein the pairs are arranged at mutual distance, said distance for instance being not more than a few millimeters, and extend at least partly along the inserting finger.

Alternatively, the array of first sensor parts of said multiple sensor devices may be provided on the inserting finger, while an array of second sensor parts of the respective sensor devices is mounted to the base part of the opening element, for instance on an attachment element that extends substantially parallel to the inserting finger.

According to a further alternative, one of the sensor parts may comprise an array of transmitting and receiving components and the other sensor part may comprise a passive sensor component, such as a reflector, a mirror or a surface with a different reflection rate than the material of the envelope.

By using such an array, it can be determined if the inserting finger has been inserted in the envelope inner space, but at the same time, such an array may be used to determine the insert depth of the inserting finger, with respect to the edge of the throat, inside the inner space of the envelope. To determine said insert depth, the array of sensor devices may detect the position of the outer edge of the envelope throat along the line of movement of the inserting finger. The edge of the envelop throat may be determined due to the fact that some of the sensor devices will detect envelope material and some of the sensor devices do not detect material when the inserting finger is inserted in said inner space of the envelope.

When the shape and/or position of the envelope throat is determined, it may be possible to accurately derive the shape of the envelope flap since the flap shape and size is related to the shape and size of the throat. In other words, the throat shape and size correspond to the area of the flap on which moistening is not useful and usually not desired. This information of the envelope throat and thus of the envelope flap may provide for a more efficient and more accurate wetting of the envelope flap connecting area, thereby for instance resulting in less spoiling of water and glue onto the document that is inserted in the envelope body resulting in an overall higher quality of filled envelopes.

In an alternative embodiment to determine the inserting depth of the inserting finger, it may instead be possible to additionally provide an inserting position sensor device onto the opening element. Such a device may have different configurations, for instance the inserting finger position sensor device, such as a pulse disk assembly, in which a pulse disk is connected to the rotation axis of the opening element and a detection element is connected to a fixed part of the inserting apparatus, may be provided on the inserting apparatus such that relative rotation of the opening element with respect to the inserting apparatus may be detected.

In a different embodiment of the inserting finger position sensor device, a first detection sensor part may be provided on the opening element and a second detection sensor part may be provided on the inserting apparatus, preferably on a fixed part of the inserting apparatus, for instance on the inserting apparatus frame. Said first and second detection sensor parts may cooperate to detect relative displacement of the opening element with respect to the inserting apparatus. The inserting finger position sensor device may comprise different kinds of sensors, for instance as described with the sensor device for detecting if the inserting finger has entered inside the envelope inner space.

After the envelope opening and finger insertion, it may appear that at least one of the inserting fingers, for instance the inserting finger that is inserted in the envelope inner space at the location where the throat is the deepest, will not extend in the inner space while other fingers have entered the inner space. In some cases this may be undesired. In dependence of the detected position of for instance the middle inserting finger, the inserting depth of said finger may be adjusted.

The opening element may be a hook element having the base part that is configured to allow movement of the opening element at least with respect to the envelope holder. The opening element inserting finger may be arranged at an angle to the base part. In an advantageous embodiment of the inserting apparatus according to the invention, the opening device further comprises at least one suction cylinder adapted to displace the envelope throat, wherein the hook element is mechanically coupled to the suction cylinder to allow rotation of the hook element after displacement of the throat by the suction cylinder. Due to this construction of opening device of the inserting apparatus according to the invention, the opening element may be suitable to experience a large movement upon insertion in the envelope. Consequently, the opening device is suitable to be used with envelopes having all kinds of throats with different dimensions.

When the opening element inserting finger and the suction cylinder both extend in the same plane, which plane extends substantially parallel to the document inserting path, the inserting finger may be inserted in the envelope throat at the same location as where the suction cylinder engages the envelope throat. This further enhances proper insertion of the opening element inserting finger in the inner space of the envelope.

According to a further aspect of the invention, the secondary sensor part may be attached to the base part via an attachment element that extends from the base of the opening element substantially parallel to the inserting finger. The attachment element provides for an optimal positioning of both sensor parts relatively to each other.

In further elaboration of the invention, the inserting apparatus may comprise a control unit that is at least operatively connected to the sensor device and to the opening device. The opening device may be controllable in dependence of a signal from the sensor device. In case the opening element is inserted between the envelope throat and the envelope body, the sensor device determines that the insertion took place. In case the sensor device did detect that the envelope throat was not moved in between both sensor parts, a signal from the sensor device is directed at the control unit. In that case, the control unit may control the opening device to make a further attempt to insert the opening element in the envelope. In case, the further attempt fails as well, the control unit may for instance control the envelope holder to remove the unopened envelope and to supply a new envelope and bring it in the document inserting position. Due to such automatic operation, unnecessary manual interference is omitted, thereby increasing the efficiency of the inserting process. The control may also be operatively coupled to the inserting finger position sensor device and to the inserting finger of the opening element, such that the inserting depth of the inserting finger may be controlled in dependence of information transmitted by the inserting finger position sensor device.

The invention further relates to an opening element for use in an inserting apparatus, preferably according to the features of claim 23.

The invention also relates to an inserting apparatus according to claim 26. It may be clear to a person skilled in the art that the above described inserting finger position sensor device may also be used to advantage with an inserting apparatus comprising an inserting finger that is provided with a different kind of sensor device than above described with the first example of the inserting apparatus. Consequently, it may be clear that further advantageous embodiments of the inserting finger position sensor device according to claim 26 may comprise the above described features. For instance, to determine proper insertion of the inserting finger, also use may be made of an end position detector, e.g. a simple touch switch, instead of the sensor device as described with the first example. Such an end position detector may than detect if the inserting finger, at least the tip of the inserting finger, has reached a predetermined position. Such an end position detector may be used in combination with a sensor array, such as above described that detects the inserting depth of the inserting finger, to determine the throat shape. Thus, according to this example of the invention, the sensor device does not necessarily have to comprise the features as above described.

In case the fingers are designed to reach a predetermined end position, an inserting finger position sensor device is not required to determine the throat position, if the fingers are equipped with an array of sensors along the length of the insert finger. In this end position, the part of arrays covered with the envelope can be sufficient to determine the position of the throat edge. Therefore, according to another aspect of the invention, the functionality of the respective sensor device and of the respective inserting finger position sensor device may be integrated in a single sensor device that at least comprises an array of first sensor parts of multiple sensor devices provided on the inserting finger, preferably adjacent an inserting finger tip, which array extends along the inserting direction.

The invention also relates to a document processing apparatus comprising the above described inserting apparatus. Such opening element, document processing apparatus provide similar advantages and effects as described with the envelope inserting apparatus.

Further embodiments of the inserting apparatus are set forth in the dependent claims. Further features, effects and details of the invention appear from the detailed description and the drawings.

BRIEF DESCRIPTIONS OF THE DRAWINGS

Figure 2:
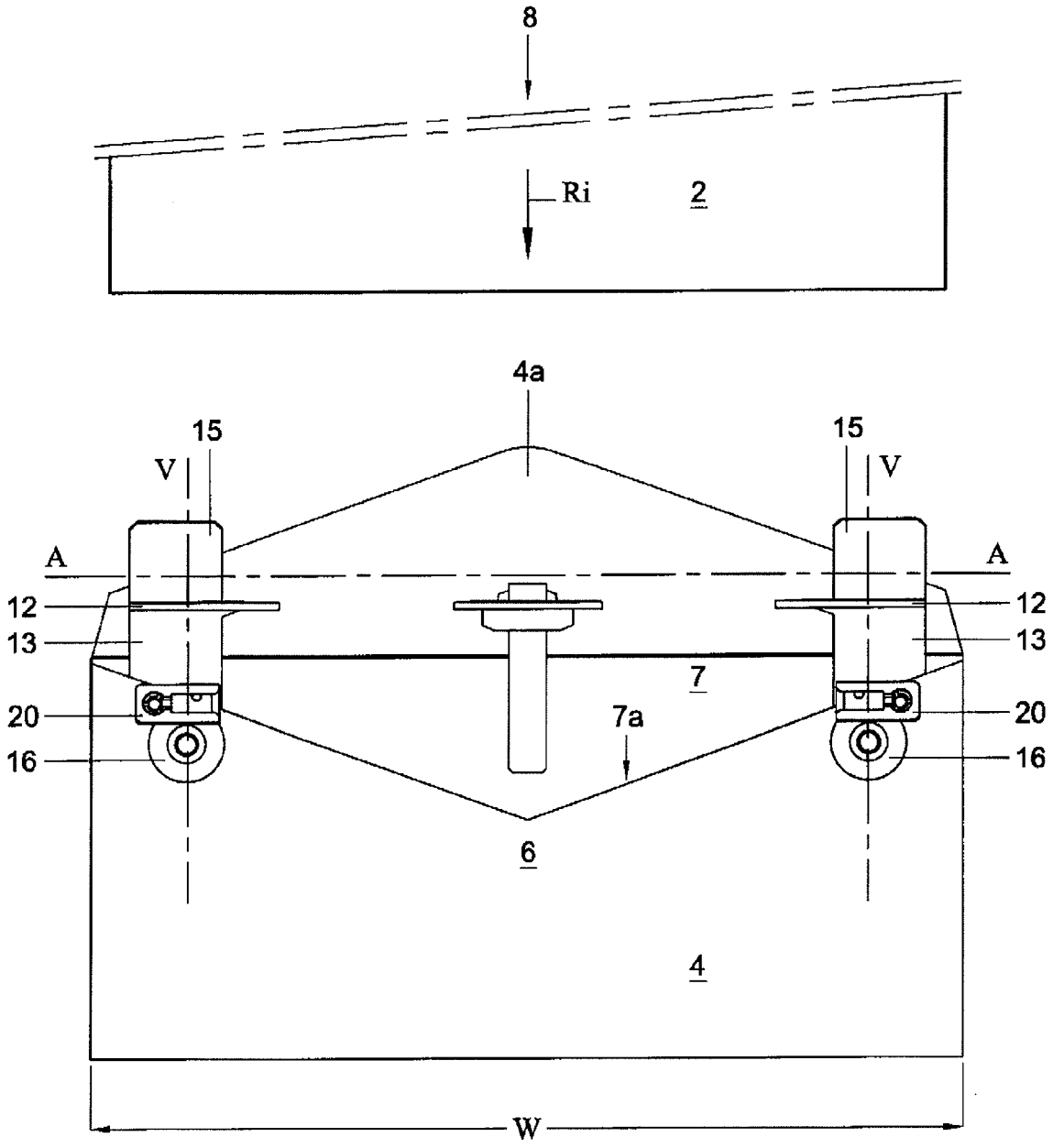
Figure 3:
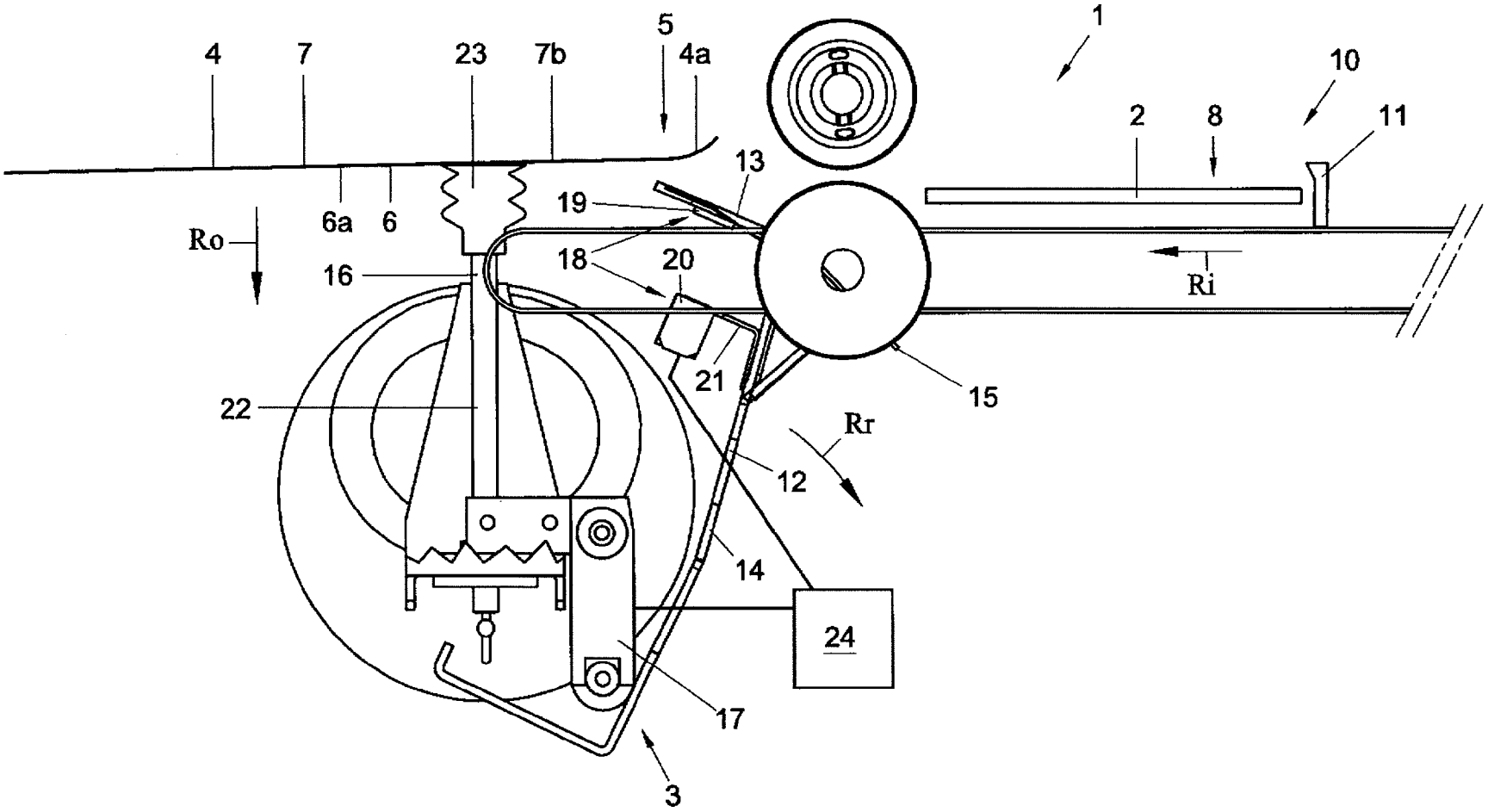
Figure 4:
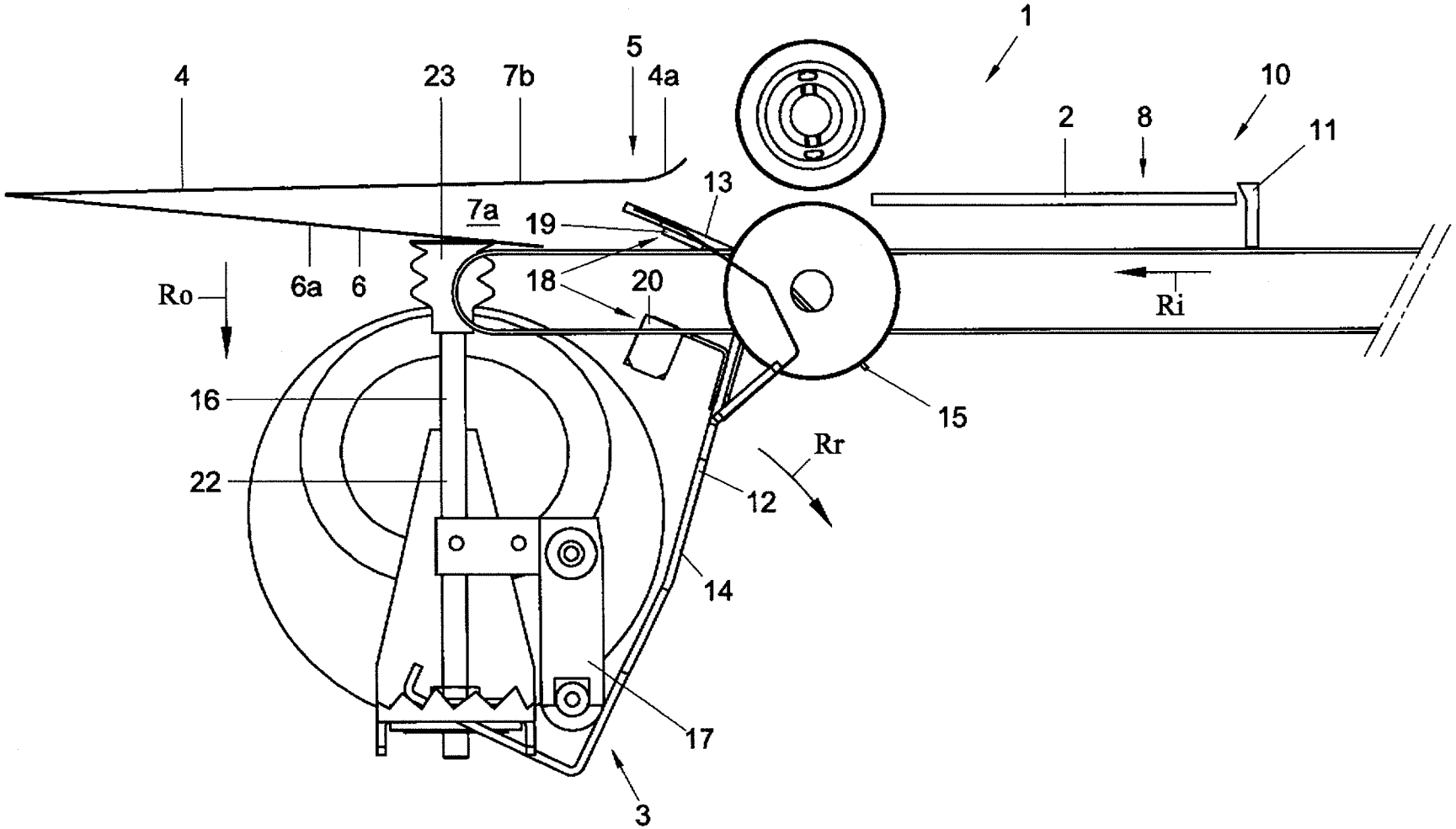
Figure 5:
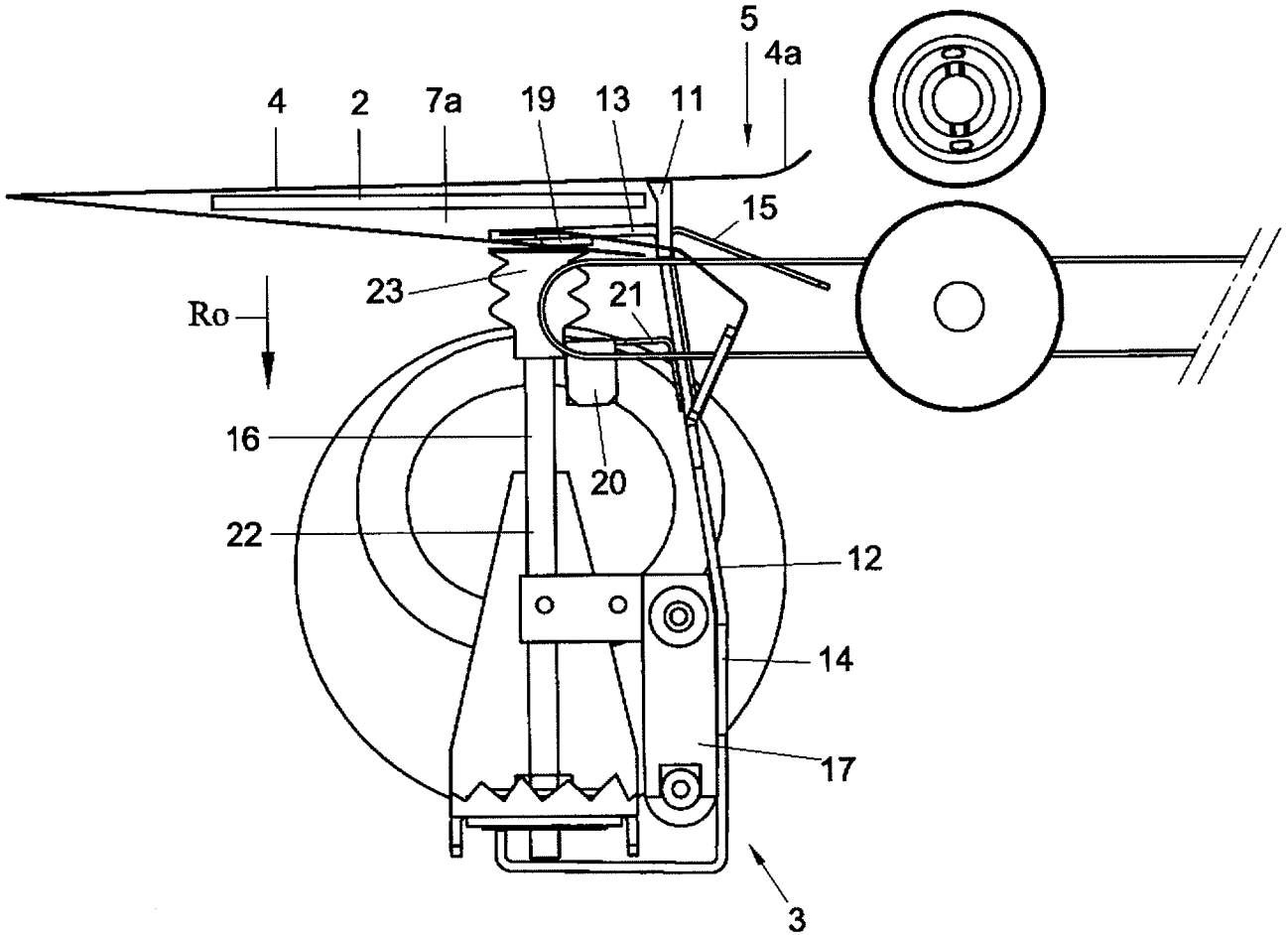
Figure 6:
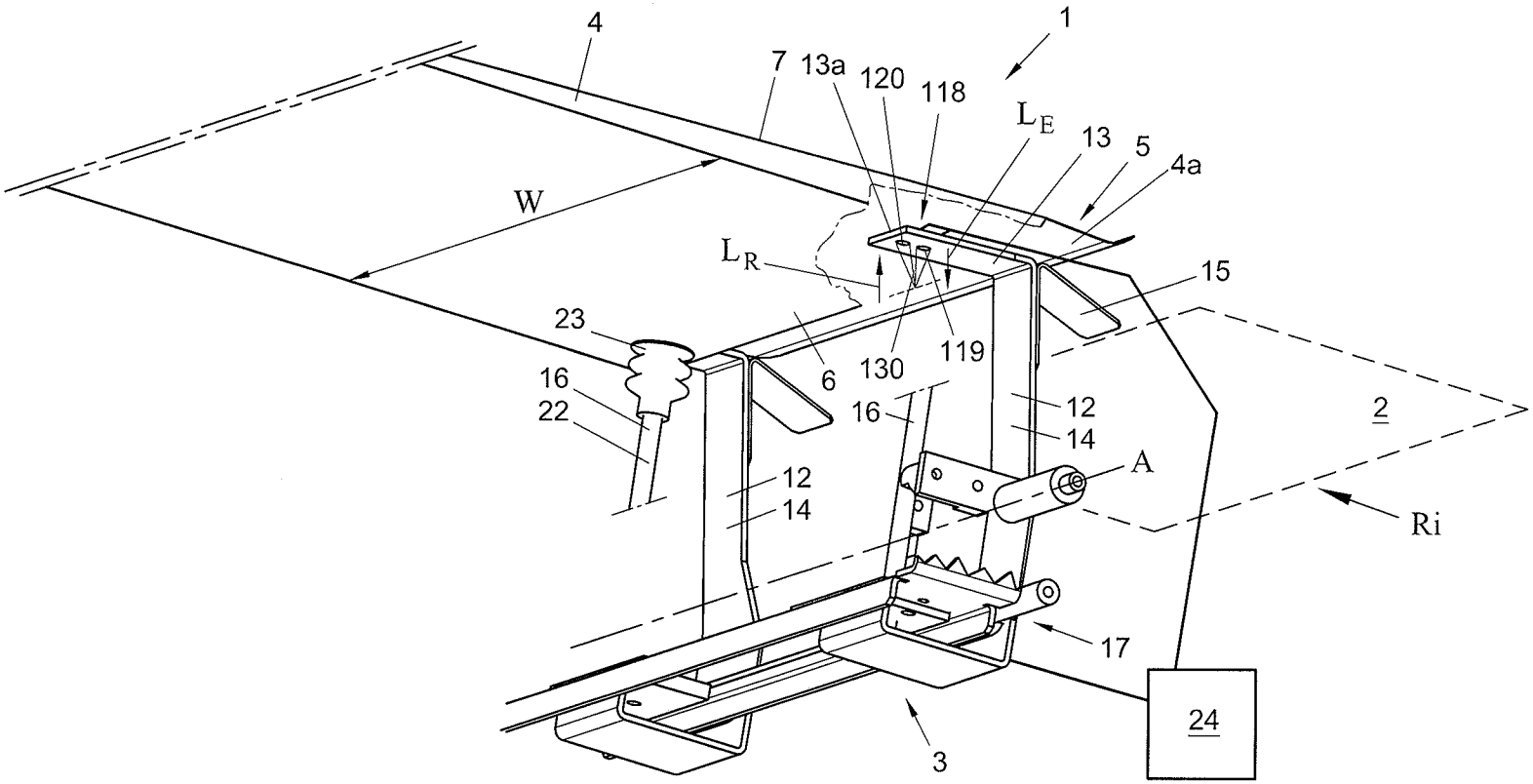
Figure 7B:
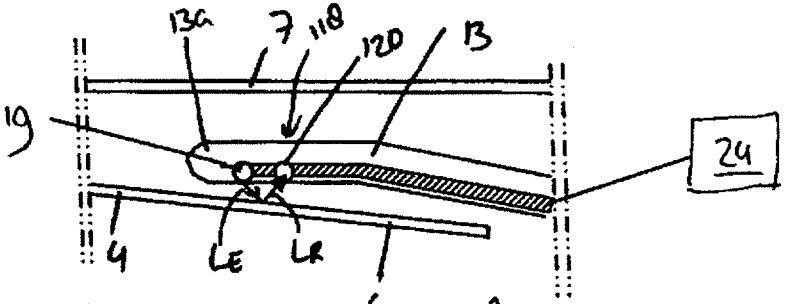
Figure 7A:
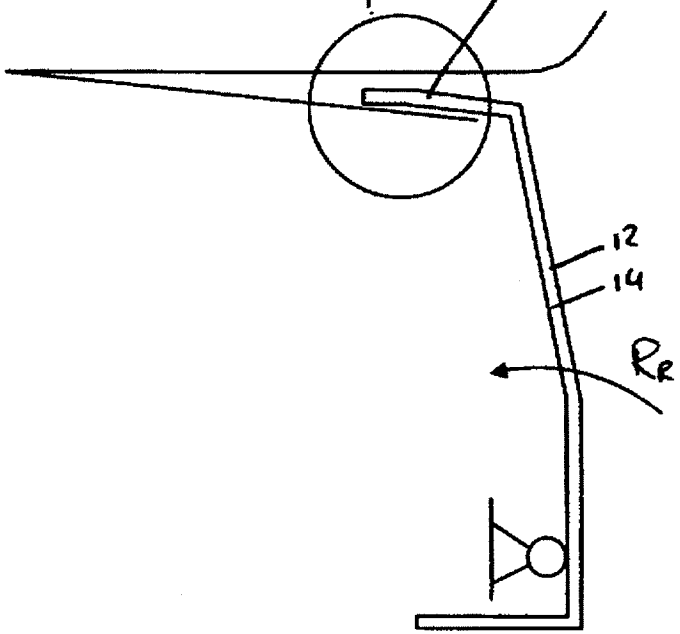
Figure 8A:
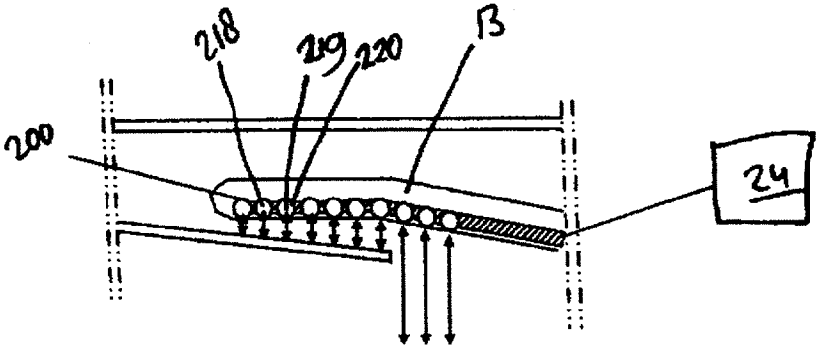
Figure 8B:
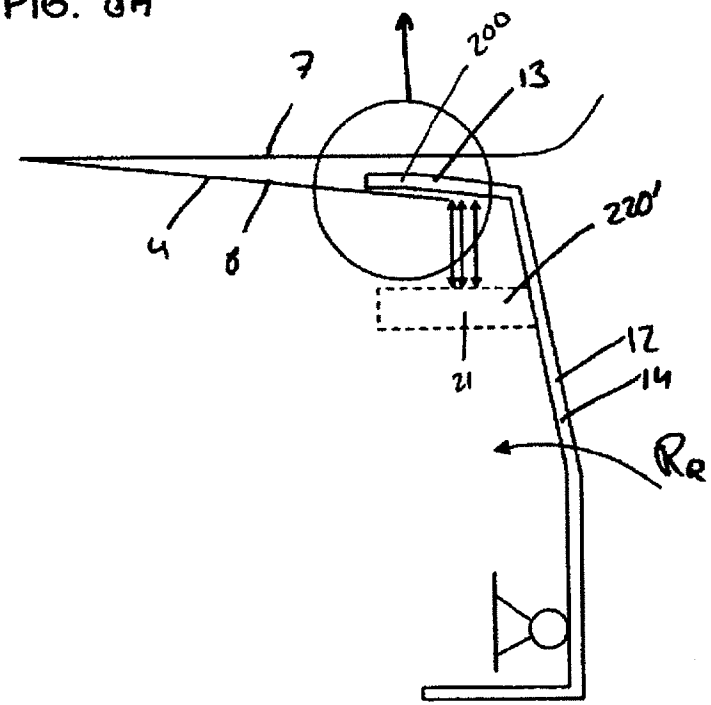
Figure 8C:
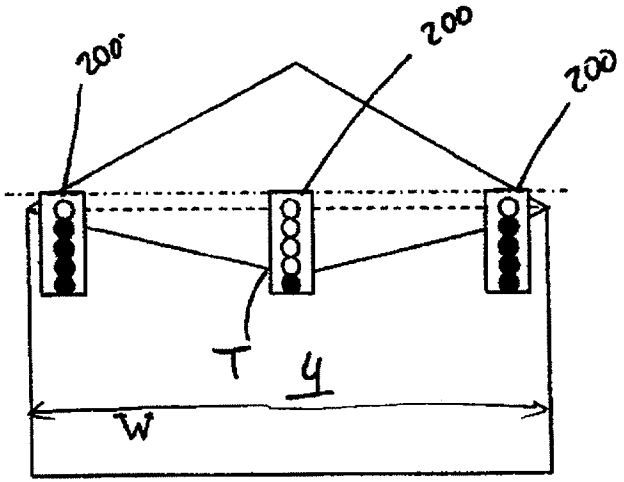
Figure 8E:
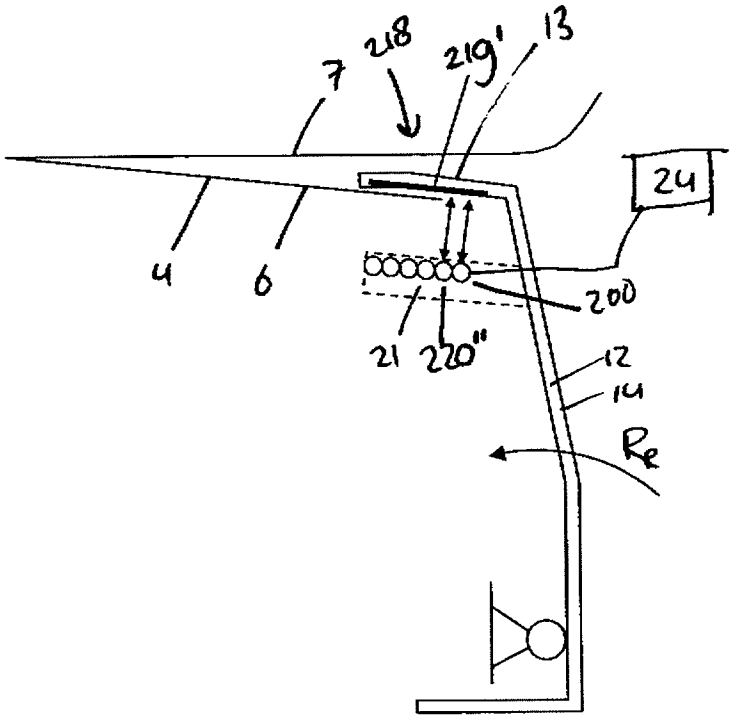
Figure 8A:
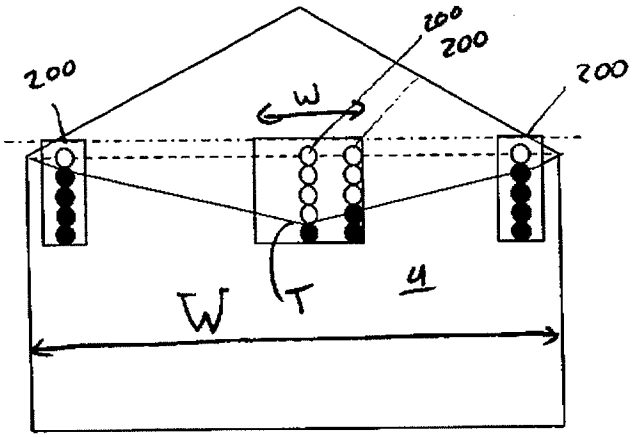
Figure 9B:
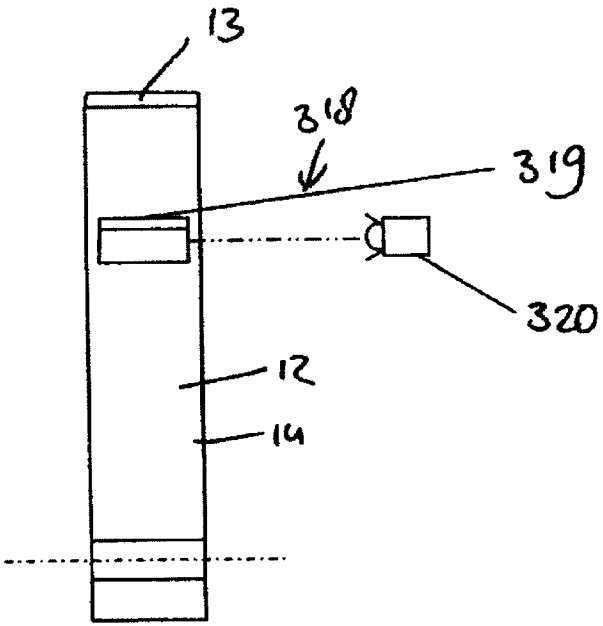
Figure 9A:
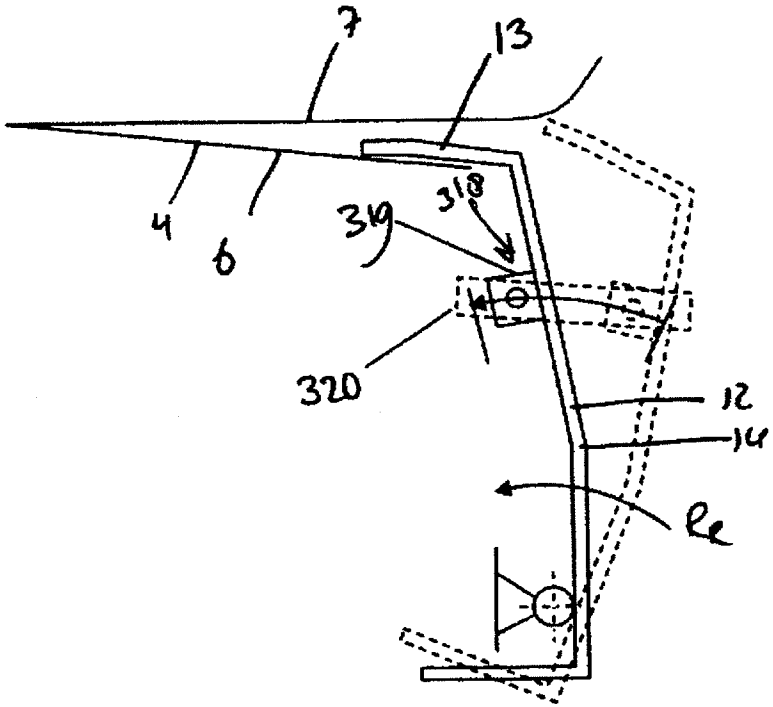
Figure 10:
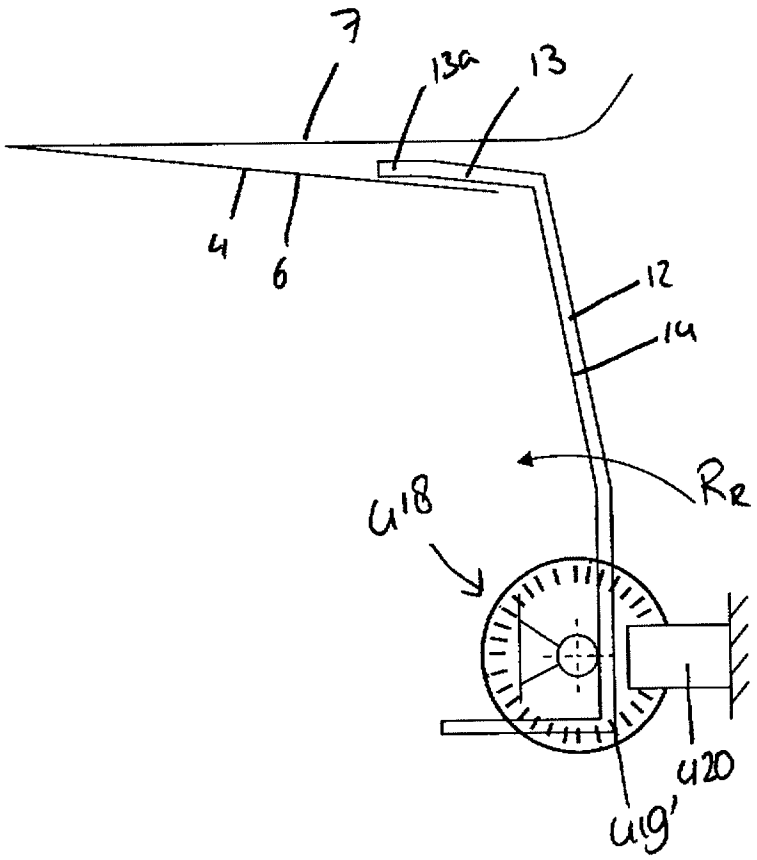

The invention will now be further elucidated by means of, non-limiting, examples referring to the drawing, in which:

FIG. 1 schematically shows a perspective view of an example of the inserting apparatus according to the invention;

FIG. 2 schematically shows a cross sectional bottom view of a part of the inserting apparatus as shown in FIG. 1;

FIGS. 3-5 schematically show respective cross sectional views of the inserting apparatus according to the invention in subsequent time intervals;

FIG. 6 schematically shows a partly cut away perspective view of a second example of the inserting apparatus according to the invention;

FIGS. 7A-7B schematically show a side view an inserting finger according to the second example of FIG. 6;

FIGS. 8A-8C schematically show an inserting finger according to a third example of the inserting apparatus;

FIG. 8D schematically shows an inserting finger according to a further example of the inserting apparatus;

FIG. 8E schematically shows an inserting finger according to another example of the inserting apparatus;

FIGS. 9A-9B schematically show a side view and a front view of an inserting finger according to a further example of the inserting apparatus;

FIG. 10 schematically shows a side view of an inserting finger according to another example of the inserting apparatus;

It is noted that identical or corresponding elements in the different drawings are indicated with identical or corresponding reference numerals.

DETAILED DESCRIPTION OF THE DRAWINGS

In FIGS. 1 and 2, a first embodiment of the inserting apparatus 1 for inserting documents 2 into envelopes 4 according to the invention is shown. The inserting apparatus 1 can be mounted on or be part of a system for processing documents, for instance downstream of a copying system or a printing system. The inserting apparatus 1 comprises an envelope holder (not shown) that holds the envelope 4 in the document inserting position as shown in FIG. 1. The envelope 4 can be fed to the envelope holder from an envelope storage along an envelope feeding path (not shown). Upstream of the envelope holder, a document inserting path 8 (see FIGS. 3-5) is arranged that in use feeds documents 2 to the envelope 4 that, at least the end 5 of the envelope 4 facing the document inserting path 8, is in a document inserting position. The document inserting position may be defined as an open position of a first upstream end 5 of the envelope 4. The open position may be obtained by moving an envelope throat 6 and an envelope body 7 away from each other. In the shown embodiment of the inserting apparatus according to the invention, the envelope throat 6 is moved away from the envelope body 7 to create the open position. This will be further described later with reference to FIGS. 3-5.

The inserting apparatus 1 further comprises a document displacement arrangement 10 (see FIGS. 3-5). The displacement arrangement 10 is arranged for displacing the document 2 along the inserting path 8 in the inserting direction Ri into the envelope 4. Therefore, the arrangement 10 comprises a displacement element 11, in this example two pushing fingers 11 that are provided transversally relative to the document inserting path 8 and which are mutually spaced apart along an opening device axis A. The axis A extends substantially perpendicular to the inserting direction Ri.

The inserting apparatus 1 further comprises an envelope opening device 3 for bringing the envelope 4 in the envelope holder in the open position. The opening device 3 comprises two opening elements 12, arranged mutually spaced apart. The opening elements 12 comprise an opening element inserting finger 13 that is arranged in an angle with respect to a base part 14 of the opening element 12. The inserting finger 13 is configured to be inserted in an inner space 7*a* of the envelope 4. The opening element 12 comprises a guiding element 15 arranged upstream of the inserting finger 13, which guiding element 15 is adapted to guide the document 2 from the displacement arrangement 10 into the inner space 7*a* of the envelope 4. The opening device 3 further comprises two suction cylinders 16 that are adapted to displace the envelope throat 6 in a direction Ro away from the envelope body 7. The opening element 12, in this embodiment a hook element, is mechanically coupled to the suction cylinder 16 by means of a coupling arrangement 17. Such coupling arrangement 17 is adapted to move the opening element 12, in this case in the retraction direction Rr, upon a movement of the suction cylinder 16 as will be described later referring to FIGS. 3-5. The coupling arrangement 17 may have many suitable configurations and may for instance comprise a cam assembly.

The inserting apparatus 1 further comprises a sensor device 18 comprising a primary sensor part 19 and a secondary sensor part 20. The sensor parts 19, 20 are configured to cooperate in order to detect the presence of the envelope throat 6 there between. The primary sensor part 19 is mounted to the inserting finger 13 of the opening element 12 (see FIGS. 3-5). The secondary sensor part 20 is mounted to the base part 14 of the opening element 12. In the shown embodiment of the invention, the secondary sensor part 20 is attached to an attachment element 21 that extends from the base part 14 substantially parallel to the inserting finger 13 in a direction to the suction cylinder 16. In the shown embodiment the sensor device 18 is an optical sensor device. In another embodiment of the invention, the sensor device 18 may instead be a mechanical sensor device. The primary sensor part 19 comprises an optical transmitter such as a light emitting diode and the secondary sensor part 20 comprises a light receiving sensor.

In another embodiment of the optical sensor device 18, one of the sensor parts 19, 20 may be a refractor or a mirror and the other one of the sensor parts 19, 20 may comprise a LED as well as the light receiving sensor. It may be advantageous if the refractor or mirror is attached to the inserting finger 13, due to its relatively flat nature.

It may also be possible to use a glass fibre conductor that may be attached to the inserting finger 13. The conductor can be operably connected to a light emitting device that emits a signal that will be transmitted by the conductor and can be received by a light receiving sensor. In this case, the light emitting device may be arranged adjacent the opening element 12. The opening elements 12 are movable with respect to each other, preferably along the opening device axis A. In case another envelope 4 with another envelope width W has to be used in the inserting apparatus 1, the position of the respective opening elements 12 can be amended according to the dimensions of the envelope 4.

As can be seen in FIG. 2, the suction cylinder 16 and the opening element 12 extend in a same plane V which extends substantially parallel to the document inserting path 8 and at the same time extends substantially perpendicular to the plane extending through the document 2. The inserting finger 13 and the suction cylinder 16 both engage with the envelope throat 7 at substantially the same position along the opening device axis A. Consequently, opening of the throat 6 may be properly controlled. As can be further seen in FIG. 2, the signal that is transmitted by the primary sensor part 19 is interrupted by the material of the envelope throat 6 such that the secondary sensor part 20 does not receive said signal. Consequently, the sensor device 18 may determine that the envelope 4 is brought in the open position and the inserting finger 13 is inserted in the inner space 7*a* of the envelope 4.

Referring now to FIGS. 3-5, operation of the inserting apparatus 1 according to the invention is described. The inserting apparatus 1 may be arranged downstream of a document collator (not shown) that collates an amount of documents 2 that are subsequently transported along the document inserting path 8 towards the inserting apparatus 1. The amount of documents 2 (for the sake of clarity further indicated as document 2) is pushed by means of the pushing fingers 11 in the inserting direction Ri. At the same time, an envelope 4 is fed to the envelope holder (not shown) and the flap 4*a* is opened such that the flap 4*a* extends from the upper part 7*b* of the envelope body 7. Preferably, the envelope 4 is held at the flap 4*a* in the envelope holder.

In the shown example, the envelope opening device 3 comprises two suction cylinders 16 and two hook elements 12 that are mechanically coupled to the respective suction cylinders 16 by the coupling arrangement 17. Preferably, the distance between the respective suction cylinders 16 can also be adjusted to a width W of the envelope 4. To open the envelope 4, the suction cylinder 16 is pushed against an outer surface 6*a* of the envelope throat 6 of the envelope body 6, which is clearly shown in FIG. 3. By pushing the suction cylinder 16 against the envelope 4, the piston 22 of the suction cylinder 16 is pushed into an air cylinder (not shown) such that air from within the air cylinder leaves said air cylinder via a small non-return valve (not shown). At that moment, the opening element 12 is retracted in a retraction direction Rr away from the suction cylinder 16 (see FIG. 3). Subsequently, the suction cylinder 16 is moved in a direction away from the envelope 4, at the same time pushing the piston 22 out of the air cylinder with aid of an internal spring in the air cylinder. The suction cup 23 of the suction cylinder 16, which suction cup 23 is located at the end of the piston 22 facing the envelope 4, is pushed against the envelope 4. A vacuum that is created in the suction cup 23 pulls the throat 6 of the envelope 4 from the envelope body 7 of the envelope 4 thereby opening the throat 6 of the envelope 4 (see FIG. 4). Then the opening element 12 is able to enter the inner space 7*a* of the envelope 4 to keep the throat 6 in an open position after removal of the vacuum (see FIG. 5). Upon displacement of the opening element 12 towards the envelope 4, the inserting finger 13 is brought between the envelope throat 6 and the envelope body 7. Consequently, the primary sensor part 19 and the secondary sensor part 20 are displaced towards the envelope throat 6 as well. When the inserting finger 13 is properly inserted in the inner space 7*a* of the envelope 4, the primary sensor part 19, in this case the LED, is inserted in the inner space 7*a* of the envelope 4 as well. Consequently, the signal that is transmitted from the primary sensor part 19 to the secondary sensor part 20 is interrupted by means of the material of the envelope throat 6. In case the envelope 4 is of a transparent material, it may be advantageous to use another kind of sensor, for instance a contact sensor. Subsequently, the document 2 may be inserted in the envelope 4, via an upper surface of the guiding element 15 and the inserting finger 13, by means of the pushing fingers 11 of the document displacement arrangement 10.

In case the inserting finger 13 is not able to be inserted in the inner space 7*a* of the envelope 4, for instance due to a failure of the suction cylinder 16 to engage with the envelope throat 6, the signal between the primary sensor part 19 and the secondary sensor part 20 will not be interrupted. The sensor device 18 may be connected to a control unit 24. When the secondary sensor part 20 will continue to receive the signal from the primary sensor part 19, even if the inserting finger 13 should have entered the envelope inner space 7*a*, the sensor device 18 transmits a signal to the control unit 24. The control unit 24 may subsequently control the opening device 3 to once more open the envelope throat 6 by means of the suction cylinder 16 and to try to insert the inserting finger 13 into the envelope 4. In case the signal between the sensor parts 19, 20 is interrupted, the document 2 may be inserted. In case the signal is not interrupted, the control unit 24 may for instance control the envelope holder to remove the current envelope 4 from said holder and replace it by another supplied envelope 4. The inserting process can continue automatically.

When another type of envelope 4 has to be used in the inserting apparatus 1 according to the invention, for instance an envelope 4 with a larger width W, the opening elements 12 may be displaced with respect to each other, for instance in a direction away from each other, along the opening device axis A. Since both sensor parts 19, 20 are attached to the respective opening elements 12, the sensor parts 19, 20 move along with the opening elements 12. Consequently, calibration of the sensor device 18 is omitted and the inserting process can be continued shortly after adapting the settings of the inserting apparatus 1 according to the envelope change. It is even possible, in a further elaboration of the invention, that the control unit 24 is adapted to displace the opening elements 12 in dependence of a change of envelopes. For instance, an operator may provide information about the envelope 4 to the control unit 24 and the control unit 24 may automatically displace the opening elements 12 and thus the sensor devices 18 attached thereto. By displacing the opening elements 12 away from each other, it is also possible to automatically measure the envelope width W of the present envelope 4 available in the envelope holder. The inserting process may therefore be a liable process, with little manual interference of an operator. Consequently, the risk of occurrence of an operator fault is minimized, the risk of occurrence of document jams and document damages is decreased and the efficiency of the inserting process is increased.

In FIG. 6, a second embodiment of the inserting apparatus 1 for inserting documents 2 into envelopes 4 according to the invention is shown. For the sake of clarity, a part of FIG. 6 is cut-away and some of the elements as shown in the previous Figures have been omitted. The inserting finger 13 and the sensor device 118 are clearly visible in FIG. 7B.

Since the inserting apparatus 1 as shown in FIG. 6 differs from the inserting apparatus as described with FIGS. 1 and 2 only with respect to the sensor device 118, only the sensor device 118 will be described here in detail. For the description of the other elements shown in FIG. 6, reference is made to the above description. In the shown embodiment of the inserting apparatus 1 according to the invention, the primary sensor part 119 as well as the secondary sensor part 120 are provided on the inserting finger 13.

The primary sensor part 119 may for instance be a light transmitter and may be adapted to emit light towards an inner envelope wall (indicated by arrow $L_E$) of the envelope 4. The secondary sensor part 120 may be a light receiving sensor and be adapted to receive light reflected and/or scattered (indicated by arrow $L_R$) by said inner envelope wall. Both sensor parts 119, 120 may be mounted to the inserting finger 13 at the same surface and may be directed to the opposing inner envelope wall. In the shown embodiment of the inserting apparatus 1, both sensor parts 119, 120 are positioned at mutual distance adjacent to each other. The primary sensor part 119 may for instance be a light emitter that emits light in a first direction $L_E$. The primary sensor part 119 may be adapted to emit light only in an emitting direction (indicated by the hatched area 130) such that emitted light is not directly received by the secondary sensor part 120. According to a further aspect of the invention, the light emitted by the primary sensor part 119 may additionally be focused towards the opposing inner envelope wall by an appropriate focussing element to further prevent emitted light being received by the second sensor part 120 without being reflected by the envelope 4.

In the shown embodiment, the secondary sensor part 120 may be mounted adjacent to the inserting finger end 13*a* (i.e. the tip of the inserting finger that in use extends towards the envelope 4), and the primary sensor part 119 may be mounted next to the secondary sensor part 120 at a side thereof facing away from the inserting finger end 13*a* (see FIG. 6).

In an alternative embodiment, the primary sensor part 119 may be mounted next to the inserting finger end 13*a* and the secondary sensor part 120 may be provided at a location next to the primary sensor part 119 facing away from the inserting finger end 13*a* (see FIG. 7B). In a further alternative embodiment, the sensor parts 119, 120 may be provided next to each other mutually spaced apart along an imaginary line that extends substantially perpendicular to the inserting direction. In another alternative embodiment, the sensor parts 119, 120 may be provided concentrically with respect to each other. In other words, one of the sensor parts 119, 120 may be provided concentrically around the other one of the sensor parts 119, 120. In all mentioned embodiments of the sensor device 118, the distance between both sensor parts 119, 120 may be small, for example smaller than a few millimeters, depending on the kind of sensor parts 119, 120 that are used.

In use, to detect proper insertion of the inserting finger 13 in the envelope 4, the primary sensor part 119 may emit light in the light emitting direction $L_E$. In case the inserting finger 13 is inserted properly in the inner space 7*a* of the envelope 4, the emitted light is scattered and/or reflected in a certain way, for instance dependent on the kind of material of the envelope 4. Reflected light (reflected in direction $L_R$) may be received by the secondary sensor part 120. Upon detection of the reflected light, a signal may be transmitted to the control unit 24 to determine if the reflected light corresponds to the predetermined reflection for the kind of envelope to be filled. If so, the document 2 may be inserted in the envelope 4 as is explained before with reference to FIGS. 3-5.

In case the reflection deviates with more than a predetermined margin from a predetermined reflection level, no reflection or full reflection, in case one of the sensor parts is used as a mirror, is detected, the inserting finger 13 may not be properly inserted in the inner space 7*a* of the envelope 4. A signal is transmitted to the control unit 24, such that the control unit 24 for instance may control the opening device 3 to once more open the envelope throat 6 by means of the suction cylinder 16 and to try to insert the inserting finger 13 into the envelope 4. In case the reflection detected by the secondary sensor part may be within a predetermined range of reflection levels, the document 2 may be inserted. In case the reflection deviates from the predetermined reflection range, the control unit 24 may for instance control the envelope holder to remove the current envelope 4 from said holder and replace it by another supplied envelope 4. The inserting process can continue automatically. For operation of the entire inserting apparatus 1 comprising the sensor device 118 according to the second embodiment of the invention, reference is made to the above description with reference to FIGS. 3-5.

In FIGS. 8A-8E further examples of an inserting finger 13 comprising a sensor device 218 is shown. The sensor device 218 comprises an array 200 of multiple sensor parts. The array 200 may comprise pairs of primary and secondary sensor parts 219, 220 provided on the inserting finger 13 as can be seen in FIG. 8A. The pairs may be mutually spaced. Alternatively, the secondary sensor parts 220' may instead be provided on an attachment element 21 as is indicated with a discontinuous line in FIG. 8B. The sensor parts 219, 220 may be operatively coupled to the control 24. In operation, the array 200 of sensor parts may determine if the inserting finger has entered inside the inner space of the envelope. Furthermore, such an array 200 may be used to determine the shape and/or position of the envelope throat 6 of the envelope 4 to be filled. At the deepest location T (see FIG. 8C) of the throat, less material is detected by the array 200 of sensor parts 219, 220 (indicated by the black dots). Consequently, the control 24 may determine the shape of the envelope throat and may use this information to derive the shape of the envelope flap to control the wetting of the area to be glued on the envelope flap, and/or adapt the insert depth of at least one of the fingers. By controlling said wetting, excessive wetting of the respective part of the envelope flap may be minimized.

For proper shape determination it may be beneficial to add more than one sensor pair along the width w of at least one inserting finger 13 (see FIG. 8D) or to use a larger number of inserting fingers each provided with sensor devices along the width W of the envelope (not shown). Since the throat shape is usually symmetrical, such detection using more than one sensor pair along the width w of at least one inserting finger may be limited to one half of the envelope 4, or detection may take place at asymmetrical positions along the width of the envelope 4. It is noted that the width W of the envelope 4 is defined as the dimension of the envelope 4 extending along the side of the fold line of the flap.

In FIG. 8E, a further example of the inserting finger 13 according to the invention is shown. One of the primary and secondary sensor parts 219', 220" may be a passive sensor component 219', such as a surface that has a reflection of the used emitted frequency that is substantially different from commonly used envelope materials and colours. For instance, said sensor part 219' may be a reflecting surface such as a mirror but also a surface with a much higher absorption than the envelope surface. The passive component 219' may be provided on the inserting finger 13 and the array 200 of sensor devices 220" may be provided on the base part 14, for instance on the attachment element 21 extending from the base part 14. Of course, in the embodiment as shown in FIGS. 8A and 8B, if necessary such a passive component may be provided on the attachment element.

Due to the possibility to determine the inserting depth of the inserting finger at different locations along the throat 6 of the envelope 4, the inserting apparatus may be controlled more accurately. For instance, in case the inserting finger 13 is not able to enter the envelope inner space, a possible repeat of the inserting operation may be undesirable and thus prevented. Also when at least one inserting finger 13 does not enter the envelope to a predetermined minimal extend, proceeding to insert documents may be undesired. In dependence of the determined shape of the envelope 4, the position of the fingers 13 may be adapted without user interaction.

In FIGS. 9A and 9B, a further example of an opening element 12 comprising an inserting finger 13 is shown. With such an opening element 12, determination of the inserting depth of the inserting finger 12 and determination of the shape of the envelope throat 6 may be provided with a separate inserting finger position sensor device 318. A first part 319 of the detection sensor 318 is provided on the opening element 12, for instance on the base part 14 outside the envelope. The second part 320 of the sensor device 318 may be mounted to the frame of the inserting apparatus. The second sensor part 320 may for instance be an array of detectors that can detect multiple positions of the first sensor part 318 with respect to the frame, thus of the inserting finger 13 with respect to the envelope throat 6.

In FIG. 10 a further example of the inserting finger position sensor device 418 is shown. The device 418 is configured to determine the rotational displacement of the opening element 12 with respect to the inserting apparatus. The device 418 may for instance comprise a pulse disk. In combination with any one of the sensor devices as described with FIGS. 1-7B, it may be easy to detect the position of the inserting finger 13 with respect to the throat edge and to determine the throat shape. Such a combination of sensors may provide the possibility to cover a wide range of envelope shapes to be operated in the inserting apparatus without the need for setting the apparatus manually.

It is noted that instead of the described inserting finger position sensor devices, other kinds of sensor devices with other configurations may be used to advantage.

The shape of the envelope throat may be determined by using a sensor device to determine if the inserting finger has entered into the inner space of the envelope in combination with an inserting finger position sensor device as described above. For instance, during a test cycle the inserting fingers 13 may be inserted several times into an envelope 4, e.g. in a few steps where the fingers are inserted further and further until a desired position is determined. In a first step the inserting fingers 13 are inserted with a limited inserting depth; when the sensor device 18, 118, 218 on the fingers do not detect the paper of the envelope, the inserting fingers 13 apparently did not enter for enough into the envelope and the insert cycle is repeated a second time, where the inserting fingers 13 are inserted a bit further into the envelope 4, and so on until the sensor devices 18, 118, 218 of the inserting fingers 13 have detected the location of the edge of the throat 6. Another method to detect the envelope throat shape comprises inserting the inserting finger into the envelope during a test cycle. During inserting it may be detected at what moment the sensor is covered. Instead, the inserting finger may be retracted after insertion into the envelope, in order to determine at what moment the sensor is uncovered by the envelope.

In combination with detection of the inserting depth of the fingers, and the lateral position of the fingers, the envelope throat 6 shape may be determined. The lateral position of the fingers may be known by any kind of sensor system, including a system in which the inserting fingers are positioned laterally in accordance with the width of the envelope by means of a spindle. E.g. the position of the fingers can be determined by the rotation of the spindle driven by a motor, while the fingers move along the spindle when the spindle rotates.

Determining the position and shape of the envelope throat enables using a wider range of envelope shapes in the inserting apparatus without the operator having to change the settings manually. Furthermore, the operator may be triggered in case an envelope to be used in the inserting apparatus appears to be less suitable for instance because not all inserting fingers may be inserted with a desired inserting depth.

In case one of the inserting fingers 13 of the inserting apparatus does not extend into the envelope inner space, for instance due to a deep throat of the envelope 4 with a triangular shape (rather than a trapezoidal shape) in order to shield the documents to be inserted from the edge of the throat 6, it may be advantageous to be able to adjust the inserting depth into the envelope. By also adjusting the inserting depth, the inserting apparatus may be used to process a wide range of envelope sizes and throat shapes.

In the foregoing specification, the invention has been described with reference to specific examples of embodiments of the invention. It will, however, be evident that various modifications and changes may be made therein without departing from the broader spirit and scope of the invention as set forth in the appended claims. For instance, the inserting apparatus 1 may be arranged in a document processing system in between different apparatuses. The inserting apparatus 1 may be suitable to insert different kinds of documents 2 with different kinds of dimensions into different kinds of envelopes 4 with different kinds of dimensions. Furthermore, the document displacement arrangement 10 and the envelope holder may have different constructions. The opening elements 12 may have different constructions and shapes. Furthermore, the opening device 3 may have a different construction; the suction cylinder 16 may be replaced by another kind of element as well as the coupling arrangement 17 between the opening element 12 and the suction cylinder 16. The sensor device 18 may comprise different kinds of devices as long as it comprises a primary and secondary sensor part 19, 20, which parts both are mounted to the opening element 12. Different sensor devices and inserting finger position sensor devices may be used in different configurations in an inserting apparatus according to the invention However, other modifications, variations and alternatives are also possible. The specifications, drawings and examples are, accordingly, to be regarded in an illustrative rather than in a restrictive sense.

In the claims, any reference signs placed between parentheses shall not be construed as limiting the claim. The word 'comprising' does not exclude the presence of other features or steps then those listed in a claim. Furthermore, the words 'a' and 'an' shall not be construed as limited to 'only one', but instead are used to mean 'at least one', and do not exclude a plurality. The mere fact that certain measures are recited in mutually different claims does not indicate that a combination of these measures cannot be used to advantage.

The invention claimed is:

1. An inserting apparatus for inserting documents into envelopes, the apparatus comprising:

an envelope holder for holding an envelope at least in a document inserting position being an open position of a first upstream end of the envelope for receiving said document;

a document inserting path arranged upstream of the envelope holder for feeding at least one document to the envelope in a document inserting direction;

an envelope throat opening device being located at the inserting position and comprising at least one opening element adapted to be at least partially inserted in the envelope to move an envelope throat and an envelope body away from each other to bring the envelope in the open position, the opening element comprising an opening element inserting finger arranged to be inserted in an inner space of the envelope, wherein the inserting apparatus comprises a sensor device with a primary sensor part and a secondary sensor part, wherein the sensor device is adapted to detect if the opening element inserting finger is positioned in between the envelope throat and the envelope body, wherein the primary sensor part of the sensor device and the secondary sensor part of the sensor device are mounted to the opening element, in order to be moved along with the opening element, one of the primary sensor part and the secondary sensor part is located at said opening element inserting finger such that when said opening element inserting finger is inserted into the inner space of the envelope, said primary or secondary sensor part is positioned inside the envelope body, and when said sensor device detects that said opening element inserting finger is not correctly positioned in between the envelope throat and the envelope body, said inserting apparatus retries to open the envelope and retries to position said opening element inserting finger in between the envelope throat and the envelope body.

2. Inserting apparatus according to claim 1, wherein one of the primary sensor part and the secondary sensor part is an optical receiver and/or the other one of the primary sensor part and the secondary sensor part is an optical transmitter.

3. Inserting apparatus according to claim 1, wherein one of the sensor parts is a light emitting diode (LED) and the other one of the sensor parts is a light receiving sensor.

4. Inserting apparatus according to claim 1, wherein both the primary sensor part and the secondary sensor part are provided on the opening element inserting finger, wherein the sensor parts are adapted to detect opening of the envelope by means of reflection and/or scattering by the envelope.

5. Inserting apparatus according to claim 1, wherein the opening element is provided with an array of sensor devices, wherein the respective primary sensor parts and the respective secondary sensor parts of each sensor device are mounted in pairs, wherein the pairs are arranged at mutual distance at least partly along the opening element.

6. Inserting apparatus according to claim 5, wherein the opening element inserting finger is provided with an array of first sensor parts of multiple sensor devices, wherein an array of second sensor parts of the respective sensor devices is provided on a base part of the opening element, on an attachment element that extends substantially parallel to the inserting finger.

7. Inserting apparatus according to claim 5, wherein one of the primary and secondary sensor parts comprises an array of transmitting and receiving components and wherein the other one of the primary and secondary sensor parts comprises a passive sensor component, selected from the group of: a reflector, a mirror or a surface with a different reflection rate than the material of the envelope.

8. Inserting apparatus according to claim 5, wherein the respective pairs of primary sensor parts and the respective pairs of secondary sensor parts are provided on the opening element inserting finger.

9. Inserting apparatus according to claim 5, wherein the respective pairs of primary sensor parts and the respective pairs of secondary sensor parts are provided on the base part of the opening element.

10. Inserting apparatus according to claim 1, wherein a separate inserting finger position sensor device is provided to detect the position of the inserting finger with respect to the inserting apparatus.

11. Inserting apparatus according to claim 10, wherein the opening element is rotatably coupled to the inserting apparatus via a rotation axis, wherein the sensor device, comprising a pulse disk assembly, in which a pulse disk is connected to the rotation axis of the opening element and a detection element is connected to a fixed part of the inserting apparatus to detect rotation of the opening element with respect to the inserting apparatus.

12. Inserting apparatus according to claim 10, wherein a first detection sensor part is provided on the opening element and a second detection sensor part is provided on the inserting apparatus on an inserting apparatus frame, wherein both detection sensor parts cooperate to detect relative displacement of the opening element with respect to the inserting apparatus.

13. Inserting apparatus according to claim 1, wherein the opening element comprises a hook element comprising a base part that is coupled to the inserting apparatus with a first end to allow movement of the opening element with respect to the envelope holder and further comprising the inserting finger that is provided at an opposite end of the base part in an angle with respect to the base part.

14. Inserting apparatus according to claim 13, wherein the opening device further comprises at least one suction cylinder adapted to displace the envelope throat, wherein the hook element is mechanically coupled to the suction cylinder to allow rotation of the hook element after displacement of the throat by the suction cylinder.

15. Inserting apparatus according to claim 14, wherein the opening element inserting finger and the suction cylinder extend in a same plane, which plane extends substantially parallel to the document inserting path.

16. Inserting apparatus according to claim 1, wherein the envelope opening device comprises at least two opening elements mutually spaced along an opening device axis, which axis extends substantially perpendicular to the inserting direction, wherein the respective opening elements are displaceable in a direction along said axis.

17. Inserting apparatus according to claim 1, wherein the inserting apparatus comprises a control unit that is at least operatively connected to the sensor device and to the opening device, such that the opening device is controllable in dependence of a signal from the sensor device.

18. Inserting apparatus according to claim 17, wherein the control unit is operatively connected to the envelope holder, such that the envelope holder is controllable in dependence of a signal from the sensor device.

19. Document processing apparatus comprising an inserting apparatus according to claim 1.

20. An inserting apparatus according to claim 1, wherein at least one of the primary sensor part of the sensor device and the secondary sensor part of the sensor device is provided on the inserting finger.

21. Inserting apparatus according to claim 20, wherein one of the sensor parts is a refractor or a mirror and the other one of the sensor parts comprises a LED and a light receiving sensor.

22. Inserting apparatus according to claim 20, wherein one of the sensor parts comprises a glass fibre conductor, wherein a first end of the glass fibre conductor is adapted to transmit a signal, wherein a second end of the glass fibre conductor is connected to a light emitting device and wherein the other one of the sensor parts is a light receiving sensor.

23. An inserting apparatus according to claim 1, wherein the primary sensor part of the sensor device is mounted on the opening element inserting finger and the secondary part of the sensor device is mounted on a base part of the opening element.

24. Inserting apparatus according to claim 23, wherein the primary sensor part and the secondary sensor part of the sensor device are of a mechanical nature, wherein the sensor device is a contact sensor or pressure sensor.

25. Inserting apparatus according to claim 23, wherein the sensor device is a capacitive sensor or an ultrasonic sensor.

26. Inserting apparatus according to claim 23, wherein the secondary sensor part is connected to the opening element at a distance from the primary sensor part.

27. Inserting apparatus according to claim 23, wherein the secondary sensor part is attached to the base part via an attachment element that extends substantially parallel to the inserting finger.

28. Inserting apparatus according to claim 1, wherein the sensor device is an ultrasonic sensor.

* * * * *